US005703368A

United States Patent [19]

Tomooka et al.

[11] Patent Number: 5,703,368

[45] Date of Patent: Dec. 30, 1997

[54] PASSIVE-TYPE INFRARED SENSOR SYSTEM FOR DETECTING HUMAN BODY

[75] Inventors: Hiroyuki Tomooka; Tadashi Sugimoto, both of Otsu, Japan

[73] Assignee: Optex Co., Ltd., Shiga, Japan

[21] Appl. No.: 658,878

[22] Filed: May 30, 1996

[30] Foreign Application Priority Data

Oct. 4, 1995 [JP] Japan ..... 7-284587

[51] Int. Cl.[6] ..... G08B 13/19

[52] U.S. Cl. ..... 250/349; 250/DIG. 1

[58] Field of Search ..... 250/DIG. 1, 349

[56] References Cited

U.S. PATENT DOCUMENTS

| | | | |
|---|---|---|---|
| 3,928,843 | 12/1975 | Sprout et al. | 340/567 |
| 4,746,910 | 5/1988 | Pfister et al. | 340/567 |
| 4,873,469 | 10/1989 | Young et al. | 315/155 |

FOREIGN PATENT DOCUMENTS 6-52450 2/1994 Japan .

*Primary Examiner*—Constantine Hannaher

*Attorney, Agent, or Firm*—Hamilton, Brook, Smith & Reynolds, P.C.

[57] ABSTRACT

A passive-type infrared sensor system includes first and second sensor units each including a first or second light receiving element and a first or second optical system. The first sensor unit has a "viewing" direction oriented towards an upper half of a human body so as to define a first watch area clear of a ground surface. The second sensor unit has a similar "viewing" direction oriented diagonally downwardly towards a point on the ground surface spaced a predetermined watch distance away from where it is installed so as to define a second predetermined watch area below the first watch area. This passive-type infrared sensor system also includes first and second level detecting circuits each operable to output a detection signal only when the level of an electric output signal from the associated first or second sensor unit exceeds a predetermined reference level, and a human detecting circuit for outputting, when the detection signals are outputted respectively from the first and second level detecting circuits, a human detection signal indicative of entry of a human body within a monitoring zone including the first and second watch areas.

6 Claims, 5 Drawing Sheets

PASSIVE-TYPE INFRARED SENSOR SYSTEM FOR DETECTING HUMAN BODY

RELATED APPLICATIONS

This Application claims priority to Japanese Patent Application No. 7-284587 filed Oct. 4, 1995, the contents of which are incorporated herein by reference.

BACKGROUND OF THE INVENTION

1. Field of the Invention

The present invention relates to a passive-type infrared sensor system for the non-contact detection of the presence or absence of a human body within a predetermined monitoring space in reference to change in quantity of infrared energies irradiated from the monitoring space and, more particularly, to the passive-type infrared sensor system which may be applied to a trigger switch for controlling activation of a security device such as, for example, a burglar alarm device.

2. Description of the Prior Art

A burglar alarm device has long been well known in the art which switches an illuminator lamp on, activates a signaling lamp to blink or activates an alarming buzzer or siren to emit an alarm in the event an unauthorized trespasser enters the predetermined watch area. In this burglar alarm device, a passive-type infrared sensor assembly for detecting a human body is generally employed as a trigger switch. This known passive-type infrared sensor assembly is disclosed in, for example, the Japanese Laid-open Patent Publication No. 6-52450, published Feb. 25, 1994, and includes an optical system such as a lens element having an angle of coverage that defines the predetermined watch area to be monitored, and an infrared detecting element such as a pyroelectric element for receiving through the optical system infrared energies irradiated from the watch area and for converting the incident infrared energies into an electric output signal of a level proportional to the amount of change of the incident infrared energies.

According to the above mentioned publication, change in amount of the incident infrared energies irradiated from the watch area is monitored at all times in reference to the level of the electric output signal and, in the event of the presence of a human body within the watch area, the amount of infrared energies incident on the infrared detecting element through the optical system undergoes a change, i.e., increases or decreases, by a quantity corresponding to the difference between the amount of infrared energies irradiated from the background within the watch area and the amount of infrared energies irradiated from the human body. Accordingly, the presence or absence of the human body, that is, an unauthorized trespasser within the watch area can be detected in reference to the change in amount of the incident infrared energies.

Where the infrared sensor assembly for detecting the human body is used as a trigger switch for the burglar alarm device of the type described above, it is a general practice to secure the infrared sensor assembly to an exterior wall surface of a building or a house with a "viewing" direction of the optical system oriented generally horizontally and also to adjust the sensitivity of detection of the incident infrared energies so that the watch area can extend a few meters away from the exterior wall surface. In other words, by monitoring a temperature difference between the background and the watch area, entry of the human body within the watch area is detected when the temperature within the watch area varies to increase.

However, where the infrared sensor assembly is installed outdoor such as at the exterior wall surface of the building or house, the presence of an object which provides a relatively large heat source at a location distant from the watch area, or passage of an object which provides a heat source across the watch area, may constitute a cause of change in quantity of the incident infrared energies as is the case when the human body enters the watch area, resulting in an erroneous generation of a human detection signal indicative of the presence of the human body within the watch area. By way of example, if while a high temperature source such as a boiler is located a distance away from the watch area an object passes by between the boiler and the watch area, or if an automotive vehicle such as a passenger car or a truck having an engine generating a considerable amount of heat moves at a place distant from the watch area, the amount of the infrared energies incident upon the infrared sensor assembly fluctuates considerably and, therefore, the human detection signal may often be generated erroneously.

Also, the burglar alarm device is generally set in an active state during the night to watch the watch area to monitor any possible entry of an unauthorized trespasser into the watch area. This burglar alarm device is also often set in the active state even during the daytime and this may occur when people in the house equipped with the burglar alarm device leave the house vacant. In such case, depending upon the orientation of the optical system sunlight may directly impinge upon the optical system. Considering that the sunlight has a relatively wide region of wavelength including an far infrared region, direct incidence of the sunlight will result in generation of an erroneous or false human detection signal. In this way, where the burglar alarm device is installed outdoors, the burglar alarm device may be erroneously operated depending on environments at a location distant from the space to be monitored, that is, the predetermined watch area.

Accordingly, it may be contemplated to orient the viewing angle of the optical system for collecting the infrared energies diagonally downwardly towards a point on a ground surface so that only the infrared energies irradiated from the watch area can be incident upon the light receiving element of the burglar alarm device. However, this contemplated design will also result in an erroneous operation of the burglar alarm device. Specifically, when a pet or a small animal such as, for example, a dog or cat, run loose in the garden enters the watch area, the amount of the incident infrared energies will be changed by infrared energies irradiated from the small animal in the garden and, consequently, the burglar alarm device may generate the false human detection signal.

SUMMARY OF THE INVENTION

Accordingly, the present invention is devised to substantially eliminate the problems and inconveniences inherent in the prior art infrared sensor assembly and is intended to provide an improved passive-type infrared sensor system of a type effective to avoid any possible erroneous operation which would otherwise occur under the influence of the presence of the heat source distant away from the watch areas, direct sunlight incident upon the light receiving element and/or entry of a small animal into the watch area and also effective to detect only entry of a human body into the watch areas.

In order to accomplish this object, the present invention provides a passive-type infrared sensor system which comprises first and second sensor units each including a first or second light receiving element and a first or second optical system. The first sensor unit has a "viewing" direction oriented towards an upper half of a human body so as to define a first watch area clear of a ground surface. On the other hand, the second sensor unit has a similar "viewing" direction oriented diagonally downwardly towards a point on the ground surface spaced a predetermined watch distance away from where it is installed so as to define a second predetermined watch area below the first watch area.

The passive-type infrared sensor system of the present invention also comprises first and second level detecting circuits each operable to output a detection signal only when the level of an electric output signal from the associated first or second sensor unit exceeds a predetermined reference level, and a human detecting circuit for outputting, when the detection signals are outputted respectively from the first and second level detecting circuits, a human detection signal indicative of entry of a human body within a monitoring zone including the first and second watch areas.

In the passive-type infrared sensor system of the present invention, in the event that the infrared energies irradiated from the relatively high heat source located a distance away from the watch areas fluctuate or direct sunlight falls thereupon, those infrared energies will be little impinge upon the second sensor unit having its viewing direction oriented diagonally downwardly. Instead, only the electric output signal from the first light receiving element of the first sensor unit having its viewing angle oriented horizontally exceeds the predetermined level and, therefore, there is no possibility of the human detection signal being generated.

Also, in the event that the small animal such as a dog or a cat enters the watch area, little infrared energies irradiated from such small animal will fall on the first sensor unit and, instead, the electric output signal from the second light receiving element of the second sensor unit exceeds the predetermined level and, therefore, even in this case, there is no possibility of the human detection signal being generated.

On the other hand, only when a human body enters the watch areas, infrared energies irradiated from upper and lower halves of the human body are received by the first and second light receiving elements through the first and second optical systems, respectively, resulting in that the respective electric output signals from the first and second light receiving elements exceed the predetermined levels. Accordingly, the presence of the human body within the watch areas can be detected and the human detection signal can be outputted from the human detecting circuit.

In this way, with the passive-type infrared sensor system of the present invention, entry of a human body into the watch areas can be highly accurately detected while securing an avoidance of any possible erroneous operation which would otherwise result in under the influence of the presence of the heat source distant away from the watch areas, direct sunlight incident upon the light receiving element and/or entry of a small animal into the watch area.

Also, since the zone in which the presence or absence of the human body can be detected by the second sensor unit is limited to cover from where it is installed to the point on the ground surface spaced the predetermined watch distance away therefrom. Accordingly, there is no possibility that a false alarm may be issued as a result of detection of the presence of the human body entering in a zone outside the zone where monitoring is required.

Preferably, each of the first and second level detecting circuit is of a type capable of outputting a detection signal and a non-detection signal one at a time, which signals are binary signals, and the human detecting circuit is employed in the form of an AND gate circuit which can be triggered on upon receipt of the binary signals, the passive-type infrared sensor system can be assembled compact and simplified in structure.

Also preferably, the second sensor unit is of a design wherein the second watch area can be adjusted in position in a vertical direction substantially perpendicular to the ground surface. By adjusting the second sensor unit, the watch distance can be varied suitably. If for this purpose the second sensor unit is so designed that while the second optical system is fixed in a housing accommodating the first and second sensor units therein, the second light receiving element is supported for adjustment in position in the vertical direction, the watch distance can be varied with no need to move the second optical system. Thus, since according to the present invention the second optical system need not be moved to change the watch distance, the second optical system can be concurrently used as a part of a covering of the sensor assembly while exposing itself to the outside, thereby making it possible to simplify the infrared sensor system as a whole.

Furthermore, the first and second sensor units are preferably of a design wherein the associated watch areas can be adjusted leftwards or rightwards. This design makes it possible to adjust not only the watch distance, but also the first and second watch areas in a direction leftwards or rightwards as desired.

In order for both of the watch distance and the watch areas to be adjustable in the manner described above, the use may be made of a retainer member and a rotary support member. In this case, while the first and second optical systems of the first and second sensor units are fixedly supported by the housing, the retainer member referred to above supports fixedly the first light receiving element of the first sensor unit, but supports adjustably the second light receiving element of the second sensor unit for movement in a direction up and down. The rotary support member is secured to the housing for rotatably supporting the retainer member. By this design, with a simplified structure adjustment of the watch distance and the watch areas is possible.

Preferably, the respective optical systems of the first and second sensor units may form a part of a front wall of the covering of the housing. This is particularly advantageous in that the assembly can be simplified in structure.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

Figure 1:
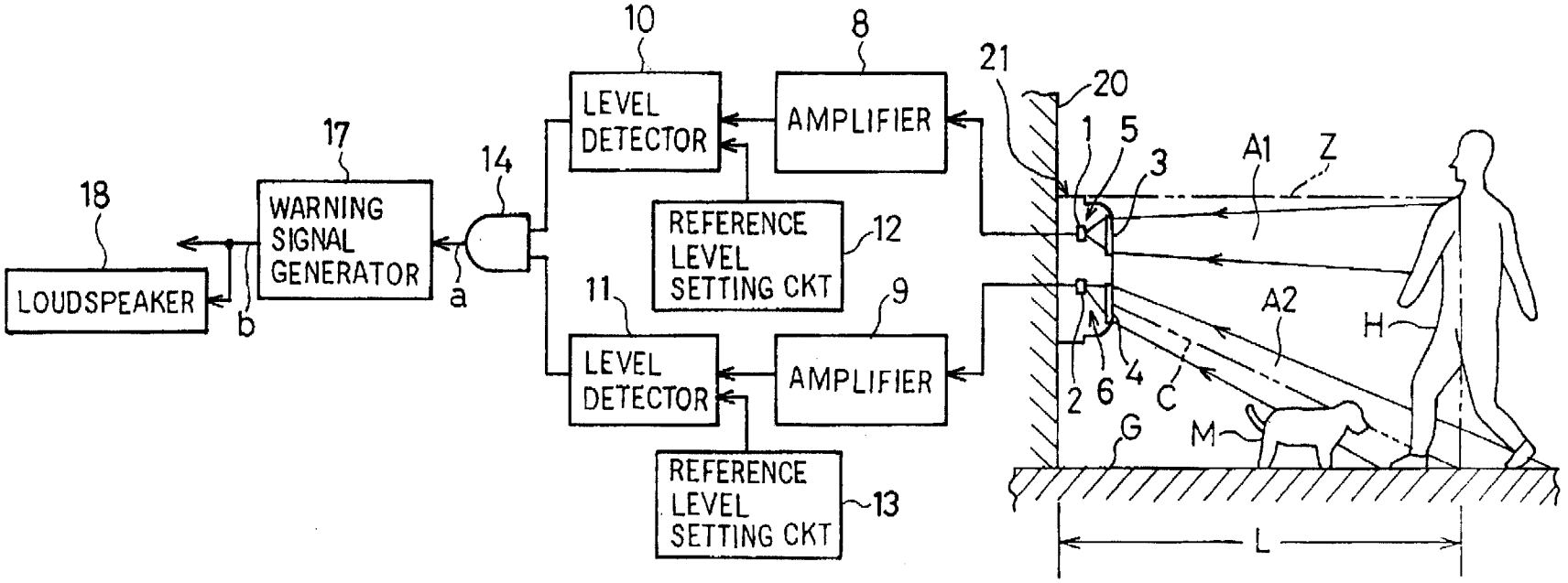
FIG. 1 is a block circuit diagram showing a passive-type infrared sensor system for detecting a human body according to a preferred embodiment of the present invention.

A preferred embodiment of the present invention will now be described with reference to FIGS. 1 to 4 in connection with a passive-type infrared sensor assembly as applied to a trigger switch in a security device such as, for example, a burglar alarm device. Referring particularly to FIG. 1, the passive-type infrared sensor assembly comprises a sensor housing 21 of a generally box-like configuration secured to an exterior wall surface 20 of a house or the like and accommodating therein upper and lower sensor units 5 and 6 positioned one above the other. The upper sensor unit 5 includes an upper light receiving element 1 and an upper optical system 3 while the lower sensor unit 6 includes a lower light receiving element 2 and a lower optical system 4.

Each of the upper and lower light receiving elements 1 and 2 is employed in the form of an infrared sensor element which may be a pyroelectric element, a thermistor-bolometer or a thermopile and is operable to output an electric output signal proportional to the amount of change of infrared energies incident upon the respective light receiving element 1 or 2. On the other hand, each of the upper and lower optical systems 3 and 4 is, in the illustrated embodiment, employed in the form of a Fresnel lens, although it may be of any suitable optical element such as, for example, at least one prism or mirror, provided that it serves to collect the infrared energies from outside and guide them onto the associated light receiving element 1 or 2.

First and second electric output signals emerging from the upper and lower light receiving elements 1 and 2 of the upper and lower sensor units 5 and 6 are amplified by respective first and second amplifier circuits 8 and 9. The amplified electric output signals are then supplied to respective first and second level detecting circuits 10 and 11. Each of the first and second level detecting circuits 10 and 11 may comprise a comparator and is operable to monitor at all times the quantity of change in level of the associated amplified electric output signal, that is, the quantity of change of a bundle of infrared rays of light falling on the corresponding upper or lower light receiving element 1 or 2.

Specifically, each of the fast and second level detecting circuits 10 and 11 compares at all times the level of the associated amplified electric output signal with the level of a predetermined electric input signal which corresponds to an infrared energy level of a background defined in a watch area to be mentioned later and which is supplied from an associated reference level setting circuit 12 or 13 and outputs a high-level detection signal only when the level of the associated amplified electric output signal exceeds the level of the predetermined electric input signal. In other words, each of the first and second level detecting circuits 10 and 11 is capable of outputting binary signals, i.e., a detection signal in a high-level state and a non-detection signal in a low-level state, one at a time.

Respective binary outputs from the first and second detecting circuits 10 and 11 are supplied to a human detecting circuit 14 which may be in the form of an AND gate circuit. This human detecting circuit 14 outputs a human detection signal a only when the respective high-level outputs from the first and second level detecting circuits 10 and 11 are simultaneously supplied thereto. This human detection signal a is in turn supplied to a warning signal generating circuit 17. The warning signal generating circuit 17 is triggered on in response to the human detection signal a to generate a warning signal b which may be utilized to activate an alarm such as a buzzer or a siren and which may also be used to activate a loudspeaker 18 to cause the latter to generate an artificial speech for warning an unauthorized trespasser such as, for example, a suspected burglar.

Figure 2A:
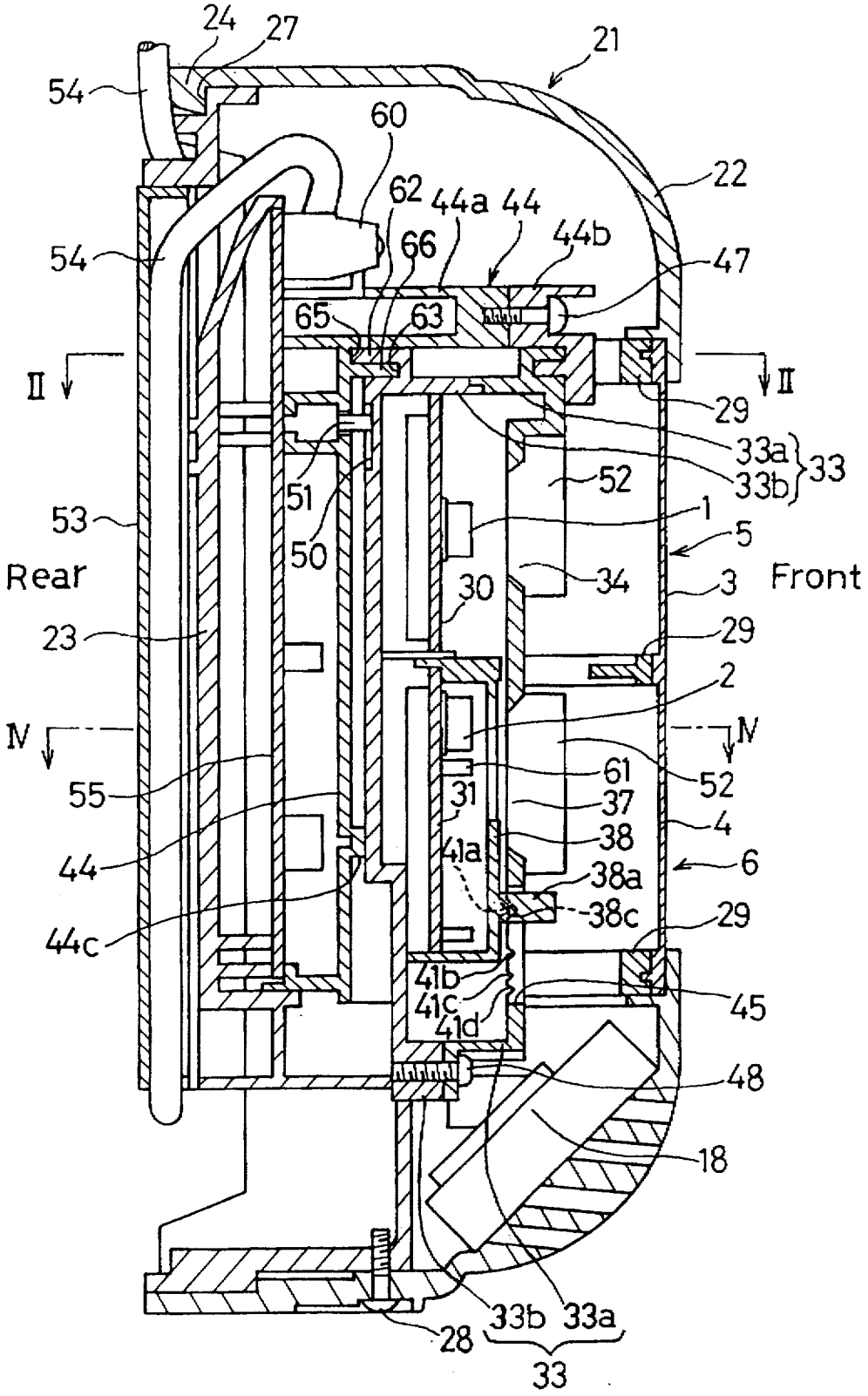
FIG. 2A is a longitudinal sectional view, on an enlarged scale, of a passive-type sensor assembly employed in the sensor system shown in FIG. 1.

The details of the passive-type infrared sensor assembly will now be described with particular reference to FIGS. 2A to 4. As best shown in FIG. 2A, the sensor housing 21 is made of synthetic resin and includes a generally rectangular covering cap 22 having an engagement hook 24 formed integrally with an upper portion thereof, and a correspondingly shaped base 23 having an engagement recess 27 defined in an upper end portion thereof. The covering cap 22 is capped onto the base 23 with the engagement hook 24 firmly snapped into the engagement recess 27. To avoid an accidental separation of the covering cap 22 from the base 23, at least one lock screw 28 is passed through a lower portion of the covering cap 22 and then firmly threaded into a lower end portion of the base 23.

The covering cap 22 also includes upper, intermediate and lower lens holders 29 of a generally semicircular frame-like configuration fitted thereto. The upper and lower optical systems or Fresnel lenses 3 and 4 are supported respectively by corresponding lens mounts defined between the upper and intermediate lens holders 29 and between the intermediate and lower lens holders 29 and are exposed to the outside of the covering cap 22 while forming respective parts of a front wall of the covering cap 22.

The upper and lower light receiving elements 1 and 2 are mounted on generally rectangular upper and lower printed circuit boards 30 and 31, respectively, which are in turn accommodated within a generally cylindrical retainer casing 33 and positioned one above the other along the longitudinal axis of the sensor housing 21. This cylindrical retainer casing 33 is comprised of front and rear casing portions 33*a* and 33*b* coupled together by means of screw members 48. The front casing portion 33*a* of the retainer casing 33 is formed with upper and lower light incident windows 34 and 37 defined therein and positioned one above the other in alignment with the upper and lower light receiving elements 1 and 2, respectively.

Specifically, the upper light receiving element 1 is fixedly mounted on the upper printed circuit board 30 within the retainer casing 33 as to confront the upper Fresnel lens 3 through the upper light incident window 34. On the other hand, the lower light receiving element 2 is fixedly mounted on the second printed circuit board 31 within the retainer casing 33 so as to confront the lower Fresnel lens 4 through the lower light incident window 37 and is supported for adjustment in position together with the second printed circuit board 31 within the retainer casing 33 in a vertical direction parallel to the longitudinal axis of the retainer casing 33 in a manner which will now be described.

Figure 4:
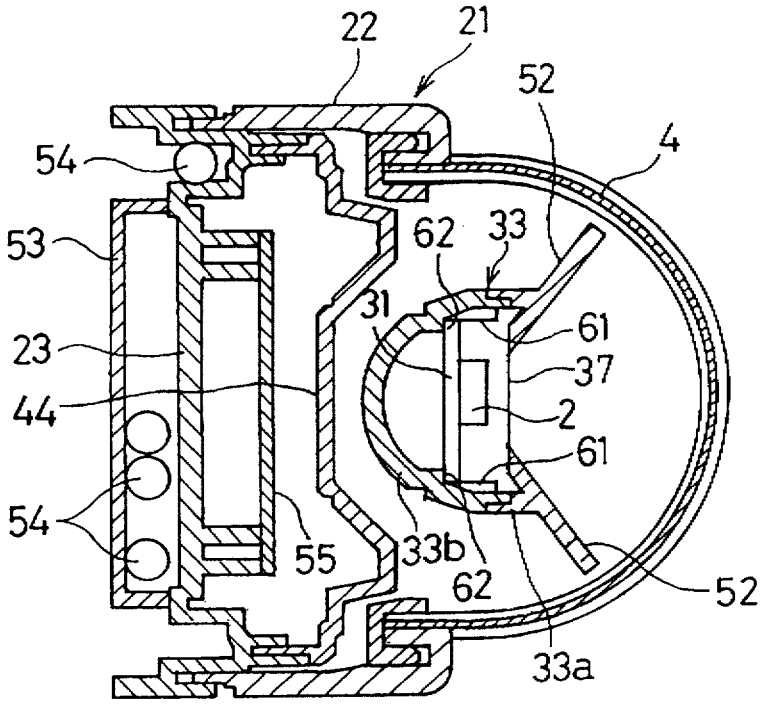
FIG. 4 is a cross-sectional view taken along the line IV—IV in FIG. 2A.

The lower printed circuit board 31 having the lower light receiving element 2 of the lower sensor unit 6 mounted thereon is supported in the following manner for movement up and down along the longitudinal axis of the sensor housing 21 to make it possible to adjust the position of the lower light receiving element 2 relative to the lower Fresnel lens 4. The rear casing portion 33*b* of the retainer casing 33 is, as best shown in FIG. 4, formed at its opposite side portions with upper and lower pairs of side guide pieces 61 spaced a distance from each other in the vertical direction and protruding frontwardly towards the lower Fresnel lens 4. This rear casing portion 33*b* is also formed at its opposite side portions with stepped longitudinal guides 62 each extending longitudinally thereof. The lower printed circuit board 31 is fitted to a support frame 38 made of soft synthetic resin and having an elasticity and is movable up and down with its opposite side portions held in sliding contact with the side guide pieces 61 of the upper and lower pairs and the stepped longitudinal guides 62, respectively.

As shown in FIG. 2A, the support frame 38 has an operating knob 38*a* formed integrally therewith, or otherwise connected rigidly thereto, so as to protrude frontwardly towards the lower Fresnel lens 4, and a detent projection 38*c* of a generally triangular configuration is formed on a right-hand side of the operating knob 38*a*. The front casing portion 33*a* of the retainer casing 33 is formed with a generally rectangular guide slot 45 defined therein for receiving the operating knob 38*a* therethrough and for defining the stroke of adjustment of the operating knob 38*a* and also with a plurality of, for example, four, detent recesses 41 a to 41*d* that are held in position to align with the path of movement of the detent projection 38*c* integral with the operating knob 38*a*. The detent projection 38*c* selectively engages in one of the detent recesses 41*a* to 41*d*.

When the lower light receiving element 2 of the lower sensor unit 6 is desired to be moved or repositioned relative to the lower Fresnel lens 4 in a longitudinal direction, an attendant worker should apply a pushing force to the operating knob 38*a* to urge the latter rearwardly (in a left-hand direction as viewed in FIG. 2A) accompanied by flexing of the support frame 38 against its own elasticity to disengage the detent projection 38*c* from one of the detent recesses, for example, the detent recess 41*a*. In this condition, the lower printed circuit board 31 is ready to move up and down. As the operating knob 38*a* is then moved upwardly or downwardly along the guide slot 45, the lower printed circuit board 31 is correspondingly moved upwardly or downwardly in sliding contact with and having been guided by the side guide pieces 61 of the upper and lower pairs and the stepped longitudinal guides 62.

When application of the external pushing force to the operating knob 38*a* is released from the operating knob 38*a* once the lower printed circuit board 31 has been moved to any desired position, the detent projection 38*c* is instantaneously clicked into another one of the remaining detent recesses 41*b* to 41*d* which corresponds in position to the desired position for the lower printed circuit board 31. In this way, a lower watch area covered by the lower light receiving element 2 can be altered as will be described in detail later.

Figure 3:
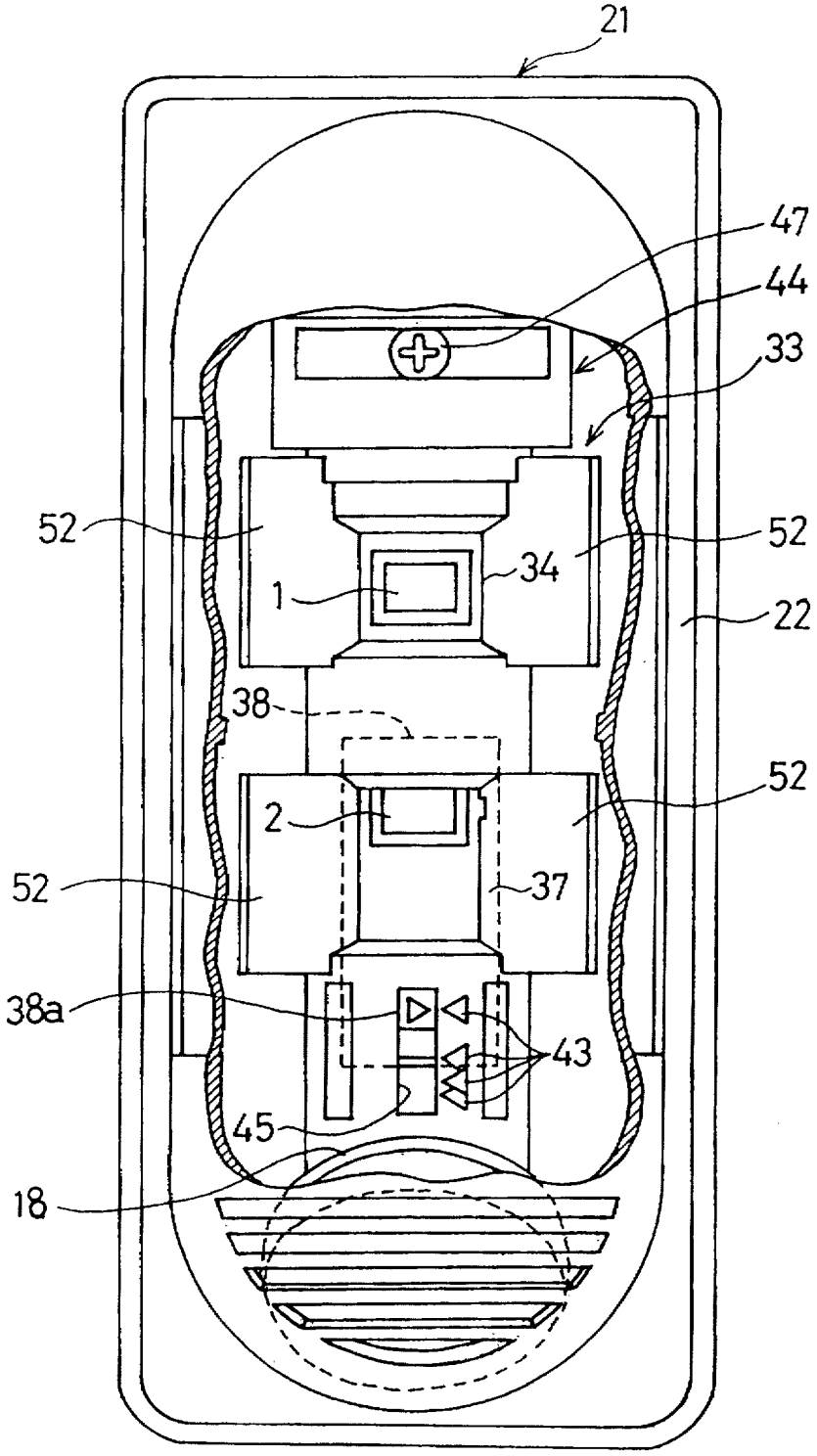
FIG. 3 is a front elevational view, with a portion cut away, of the passive-type sensor assembly shown in FIG. 2.

It is to be noted that, as shown in FIG. 3, positions of the detent recesses 41*a* to 41*d* to which the operating knob 38*a* is selectively moved are marked respectively by embossed or printed triangle markings, generally identified by 43, each together with a legend (not shown) descriptive of the watch distance which the lower light receiving element 2 then positioned to any one of the detent recesses 41*a* to 41*d* can aim at.

Figure 2B:
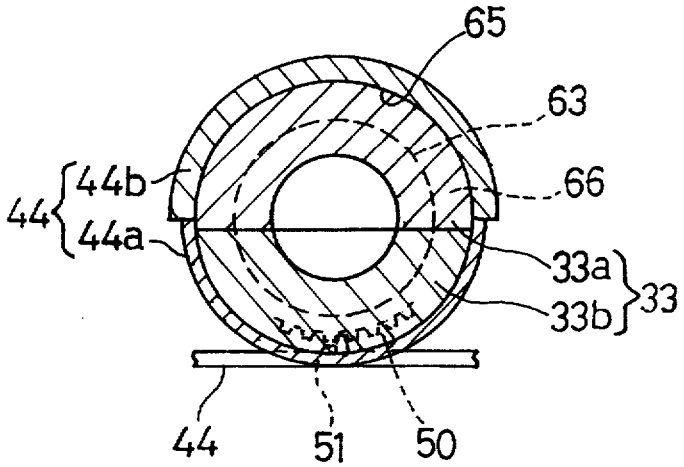
FIG. 2B is a cross-sectional view taken along the line II—II in FIG. 2A.

The retainer casing 33 carrying the upper and lower printed circuit boards 30 and 31 and, hence, the upper and lower light receiving elements 1 and 2 is so rotatable about the longitudinal axis thereof as to enable respective watch areas A1 and A2 of the upper and lower sensor units 5 and 6 to be adjusted. For this purpose, an upper portion of the retainer casing 33 is formed with a generally ring-shaped collar 62 and an annular groove 63 defined below such ring-shaped collar 62. On the other hand, the base 23 has a rotary support member 44 secured thereto, which member 44 is constituted by a body 44*a* and a cap 44*b* secured to the body 44*a* by means of a set screw 47. An annular groove 65 and an annular collar 66 are formed over the body 44*a* and the cap 44*b*. As shown in FIG. 2B, with the collar 62 of the retainer casing 33 engaged in the groove 65 in the rotary support member 44 and, also, with the groove 63 in the retainer casing 33 receiving therein the collar 66 of the rotary support member, the retainer casing 33 is supported for rotation relative to the rotary support member 44. At the same time, a rear surface of a generally intermediate portion of the retainer casing 33 is supported against a support projection 44*c* formed integrally with the rotary support member 44 to thereby avoid any possible rearward tilt of the retainer casing 33. Accordingly, by manually turning the retainer casing 33 about the longitudinal axis thereof, the respective watch areas A1 and A2 of the upper and lower sensor units 5 and 6 can be adjusted in a direction leftwards or rightwards, i.e., in a plane generally parallel to the ground surface.

The retainer casing 33 being so rotatable has a plurality of detent positions about the longitudinal axis thereof so that the retainer casing 33 can be selectively repositioned to any one of the detent positions. For this purpose, a plurality of elongated positioning holes 50 are formed on a rear surface of the upper portion of the retainer casing 33 so as to extend in a direction parallel to the longitudinal axis thereof and are, as shown in FIG. 2B, positioned spaced equidistantly in a direction circumferentially of the retainer casing 33. Cooperable with any one of the positioning holes 50 is a detent pin 51 integrally formed with the body 44*a* of the rotary support member 44 which is selectively engaged in one of the positioning holes 50 to reposition the retainer casing 33 once the latter has been turned to any desired position.

As shown in FIG. 4, the retainer casing 33 is also formed integrally with upper and lower pairs of coverage regulating plates 52 one pair for each of the upper and lower sensor units 5 and 6. Each pair of the coverage regulating plates 52 is used to limit the angle of horizontal coverage of the infrared rays of light to be incident upon the associated upper or lower light receiving element 1 or 2 through the corresponding light incident window 34 or 37.

The base 23 has a generally U-sectioned fixing plate 53 secured to a rear surface thereof by means of a plurality of set screws (not shown), and the sensor housing 21 can be mounted on the exterior wall surface 20 (FIG. 1) of a house or the like through such fixing plate 53. This fixing plate 53 concurrently serves as a guide for an electric cable 54 for electrical connection with, for example, an external electric power source. Specifically, a main substrate 55 in the form of a printed circuit board is fixedly disposed between the base 23 and the rotary support member 44 and is electrically connected with the upper and lower printed circuit boards 30 and 31 shown in FIG. 2 through connecting lines (not shown). The electric cable 54 referred to above has one end connected to a terminal 60 fixed on this main substrate 55 and extends therefrom through an interior of the fixing plate 53 downwardly and turned backwards so as to extend upwardly before the opposite end of the electric cable 54 is drawn laterally outwardly from the fixing plate 53.

Referring again to FIG. 1, the infrared sensor assembly according to the present invention is fitted to the exterior wall surface 20 at a height corresponding to the waist level of an adult. With the infrared sensor assembly so positioned, the upper and lower sensor units 5 and 6 are so arranged as to permit the upper and lower light receiving elements 1 and 2 to sense infrared energies that are irradiated from vertically spaced upper and lower regions within a predetermined monitoring zone Z to be watched which is bound by the double-dotted lines. More specifically, the upper sensor unit 5 has a "viewing" direction oriented generally horizontally towards an upper half of the human body to be monitored and, hence, has a first watch area A1 of coverage bound to an upper region of the monitoring zone Z which does not include the ground surface G. On the other hand, the lower sensor unit 6 has a "viewing" direction oriented diagonally downwardly towards a location on the ground surface G that is spaced a predetermined watch distance L away from the exterior wall surface 20 and, hence, has a second watch area A2 of coverage bound to a lower region of the monitoring zone Z including the ground surface G.

The watch distance L referred to above is defined as a distance away from the exterior wall surface 20 to a point where the mid-center line C of the second watch area A2 defined for the lower sensor unit 6 intersects the ground surface G. The monitoring zone Z to be watched is therefore bound by the watch distance L, the height of the first watch area A1 and the respective widths (i.e., horizontal coverages lying in a plane generally parallel to the ground surface G and orthogonal to the sheet depicting FIG. 1) of the first and second watch areas A1 and A2.

The operation of the infrared sensor system of the present invention discussed hereinabove will now be described.

The infrared sensor system of the present invention provides the human detection signal a only when the respective levels of the electric signals outputted from the light receiving elements 1 and 2 simultaneously exceed the predetermined reference level. By way of example, where a high temperature source such as, for example, a boiler is located a distance away from the first watch area A1, but within the sensing "reach" of the upper light receiving element 1 and an object moves in front of the high temperature source, or where a passenger car or an automotive truck runs on a road distant from the first watch area A1, but within the sensing "reach" of the upper light receiving element 1, infrared energies irradiated therefrom can be received by the upper light receiving element 1 through the upper Fresnel lens 3 of the upper sensor unit 5. The light receiving element 1 then outputs to the first level detecting circuit 10 an electric output signal of a level proportional to the amount of change of the incident infrared energies. As discussed hereinbefore with reference to FIG. 1, the first level detecting circuit 10 outputs a high-level detection signal only when the level of the electric output signal from the upper light receiving element 1 exceeds the predetermined reference level.

However, in view of the fact that the lower sensor unit 6 is oriented diagonally downwardly towards the ground surface G, the infrared energies that undergo a considerable variation as a result of passage of the object in front of the high temperature source or passage of the automotive vehicle are little caught by the lower light receiving element 2. Accordingly, the level of an electric output signal from the lower light receiving element 2 does undergo little change and, therefore, the associated second level detecting circuit 11 keeps outputting a low-level detection signal.

Thus, the high-level detection signal from the first level detecting circuit 10 and the low-level detection signal from the second level detecting circuit 11 are supplied to the human detecting circuit 14. However, in this situation, the human detecting circuit 14 employed in the form of the AND gate circuit is not triggered on and, therefore, there is no possibility of the human detecting circuit 14 generating prematurely the human detection signal a.

A similar situation may be found during the daytime during which sunlight falls on the sensor assembly. In such case, it only happens that the upper light receiving element 1 of the upper sensor unit 5 outputs the electric output signal of an increased level, and therefore, by the reason similar to that discussed above, no human detection signal a is generated from the human detecting circuit 14.

On the other hand, in the event that a small animal M such as, for example, a dog or a cat, enters the monitoring zone Z, infrared energies irradiated from such small animal M fall on the lower light receiving element 2 through the lower Fresnel lens 4 of the lower sensor unit 6, but does not fall on the upper light receiving element 1 of the upper sensor unit 5 because the upper sensor unit 5 is, as hereinbefore discussed, oriented generally horizontally. Accordingly, in such situation, only the level of the electric output signal from the lower light receiving element 2 undergoes change and the human detecting circuit 14 is not in position to generate the human detection signal a.

However, should a human body H enter the monitoring zone Z, the watch areas A1 and A2 are simultaneously intercepted and, therefore, infrared energies irradiated from the human body H fall upon the upper and lower light receiving elements I and 2 through the upper and lower Fresnel lenses 3 and 4 of the respective upper and lower sensor units 5 and 6 simultaneously. Accordingly, the upper and lower light receiving elements 1 and 2 output the respective electric output signals of levels each exceeding the predetermined reference level, causing the associated first and second level detecting circuits 10 and 11 to provide the human detecting circuit 14 with the high-level detection signals. Therefore, in such situation, the human detecting circuit 14 provides the human detection signal a indicative of entry of the human body H into the monitoring zone Z. Thus, only when the watch areas A 1 and A2 are simultaneously intercepted by a human body H entering the monitoring zone Z, the human detection signal a can be assuredly outputted from the human detecting circuit 14.

Moreover, since the viewing direction of the lower Fresnel lens 4 is oriented diagonally downwardly towards the point on the ground surface G spaced the watch distance L away from the exterior wall surface 20 as hereinbefore described, the zone in which the presence of the human body H can be detected is limited to the space encompassed by the watch distance L away from the exterior wall surface 20 and the first and second watch areas A1 and A2. Accordingly, there is no possibility that the presence of the human body H occupying a position outside the first and second watch areas A 1 and A2 is detected. In this way, the infrared sensor system of the present invention is effective to avoid the possibility that a human body H entering a space unnecessary to be watched may be detected erroneously and a false warning may therefore be issued.

Figure 5:
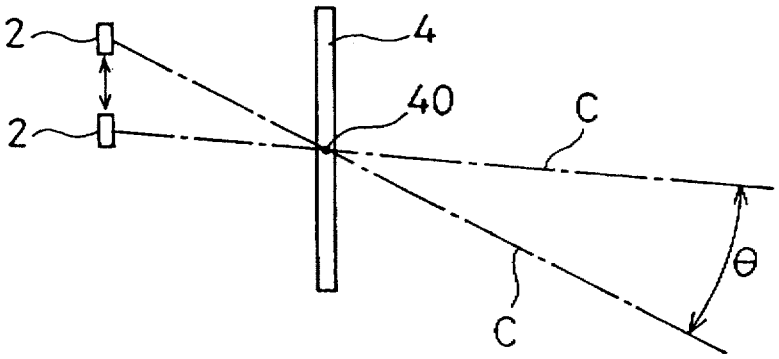
FIG. 5 is a schematic side view showing a method of changing a watch area.

The watch distance L discussed hereinabove can be adjusted in the following manner. The covering cap 22 of the sensor housing 21 shown in FIG. 2A is first removed from the base 23 which may then be secured to the exterior wall surface 20. Then, the operating knob **38*a* is to be moved manually upwardly or downwardly until the lower light receiving element 2 of the lower sensor unit 6 is brought to one of the positions corresponding respectively to the detent recesses 41*a* to 41*d*. By so doing, the mid-center line C of the second watch area A2 defined by the imaginary straight line drawn from the center point of the lower light receiving element 2 so as to pass through the center point 40 of the lower Fresnel lens 4 swings about the center point 40 of the lower Fresnel lens 4 as shown in FIG. 5 upwardly or downwardly depending on the direction in which the operating knob 38***a* is moved. Accordingly, the second watch area A2 can be adjusted upwardly or downwardly within an angle indicated by θ in FIG. 5 with the watch distance L shown in FIG. 1 consequently changed.

While the watch area A2 for the lower sensor unit 6 is adjusted up and down, rotation of the retainer casing 33, shown in FIGS. 2A and 2B, about the longitudinal axis thereof can result in change of orientation of both of the upper and lower sensor units 5 and 6 in a horizontal plane generally parallel to the ground surface G. One or both of the adjustment of the lower watch area A2 and the orientation of the upper and lower sensor units 5 and 6 in the horizontal plane may be carried out suitably or conveniently at the time of installation of the sensor assembly and/and depending on the environment and condition in which the sensor assembly is installed.

It is to be noted that the lower sensor unit 6 is of a structure wherein the associated Fresnel lens 4 is fixed to the covering cap 22 of the sensor housing 21 to thereby serve concurrently as a part of the covering cap 22. Accordingly, as compared with the structure in which a front surface of the sensor housing 21 is provided with a cover without any opening and a separate lens element is disposed inwardly thereof, the structure can be simplified advantageously. Although in the illustrated embodiment the lens element may not be supported for movement, the lower light receiving element 2 is instead supported for movement up and down relative to the lower Fresnel lens 4 and, therefore, the watch area A2 can be adjusted with no need to move the lower Fresnel lens 4.

As hereinbefore fully described, with the passive-type infrared sensor system for detecting a human body according to the present invention, the use is made of the two set of the sensor units each including the optical system and the light receiving element for providing the human detection signal only when infrared energies detected from the upper and lower regions within a space defining the predetermined watch zone undergo change in such a way as to exceed the predetermined level. Accordingly, any possible erroneous operation caused by the presence of a heat source distant from the watch zone, incidence of the sunlight or entry of a small animal into the watch area can be assuredly avoided, thereby ensuring an accurate and precise detection of the human body entering the watch areas.

Although the present invention has been fully described in connection with the preferred embodiment thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A passive-type infrared sensor system for detecting a human body, which comprises:

first and second sensor units each including a light receiving element for outputting an electric output signal proportional to an amount of change of infrared energies incident upon the light receiving element, and an optical system for collecting and guiding the infrared light from a predetermined watch area onto the light receiving element;

said first sensor unit being so disposed as to define a first watch area clear of a ground surface and oriented towards an upper half of the human body whereas said second sensor unit is so disposed as to define a second watch area below the first watch area and oriented towards a point on the ground surface spaced a predetermined watch distance away from the site where the second sensor unit is located;

first and second level detecting circuits each operable to output a detection signal only when the electric output signals generated from the light receiving elements of the respective first and second sensor units exceed a predetermined level; and a human detecting circuit for outputting a human detection signal only when the detection signals are outputted respectively from the level detecting circuits, wherein each of the first and second level detecting circuits outputs one at a time a detection signal and a non-detection signal which are binary signals, and said human detecting circuit comprises an AND gate circuit operable in response to receipt of the binary signals.

2. The passive-type infrared sensor system as claimed in claim 1, wherein said second sensor unit is so configured as to enable the second watch area to be adjusted up and down.

3. The passive-type infrared sensor system as claimed in claim 2, wherein said optical system of the second sensor unit is fixedly supported by a housing for accommodating both of the first and second sensor units, and the light receiving element of the second sensor unit is supported for movement up and down relative to the optical system of the second sensor unit.

4. The passive-type infrared sensor system as claimed in claim 3, wherein the optical system of the first sensor unit is fixedly supported by the housing, further comprising:

a retainer member for fixedly supporting the light receiving element of the first sensor unit and for supporting the light receiving element of the second sensor unit for adjustment in a direction up and down; and a rotary support member secured to the housing for rotatably supporting the retainer member.

5. The passive-type infrared sensor system as claimed in claim 3 wherein said respective optical systems of the first and second sensor units form a part of a front wall of a covering of the housing.

6. The passive-type infrared sensor system as claimed in claim 1, wherein said first and second sensor units has the associated watch areas adjustable left and right.

* * * * *